US008484864B2

(12) United States Patent
Tzeng

(10) Patent No.: US 8,484,864 B2
(45) Date of Patent: Jul. 16, 2013

(54) PRESSURE-REDUCING DEVICE

(75) Inventor: Tzann-Yuh Tzeng, Taipei (TW)

(73) Assignees: Tzann-Yuh Tzeng, Taipei (TW); Pei-Fang Tsai, Luzhu Township (TW)

( * ) Notice: Subject to any disclaimer, the term of this patent is extended or adjusted under 35 U.S.C. 154(b) by 492 days.

(21) Appl. No.: 12/789,769

(22) Filed: May 28, 2010

(65) Prior Publication Data

US 2010/0307024 A1 Dec. 9, 2010

(30) Foreign Application Priority Data

Jun. 6, 2009 (TW) ..... 98118880 A

(51) Int. Cl.
*A43B 13/38* (2006.01)

(52) U.S. Cl.
USPC ..... 36/43; 36/71; 36/140

(58) Field of Classification Search
USPC ..... 36/43, 44, 71, 80, 140, 145, 166, 36/169, 173
See application file for complete search history.

(56) References Cited

U.S. PATENT DOCUMENTS

| | | | | | |
|---|---|---|---|---|---|
| 975,576 | A * | 11/1910 | Sexton | 36/43 |
| 2,054,151 | A * | 9/1936 | Whitman | 36/173 |
| 2,221,202 | A * | 11/1940 | Ratcliff | 36/155 |
| 2,567,028 | A * | 9/1951 | Rapisarda | 36/173 |
| 2,884,717 | A * | 5/1959 | Goldberg | 36/169 |
| 3,421,518 | A * | 1/1969 | Wikler | 36/173 |
| 3,470,880 | A * | 10/1969 | Pagliano | 36/178 |
| 4,168,585 | A * | 9/1979 | Gleichner | 36/95 |
| 4,541,184 | A * | 9/1985 | Leighton | 36/44 |
| 4,862,604 | A * | 9/1989 | Hauser | 36/43 |
| 6,247,250 | B1 * | 6/2001 | Hauser | 36/44 |
| 2004/0211086 | A1 * | 10/2004 | Dananberg | 36/11.5 |
| 2008/0098621 | A1 * | 5/2008 | Tzeng et al. | 36/44 |

* cited by examiner

*Primary Examiner* — Marie Patterson
(74) *Attorney, Agent, or Firm* — C. G. Mersereau; Nikolai & Mersereau, P.A.

(57) ABSTRACT

The pressure-reducing device has a body, a heel portion and an elevation portion. The body has a thickness and a body-fore end. The heel portion is defined in the body. The elevation portion is defined in the body and has a rear boundary and a fore boundary. The rear boundary is adjacent to the heel portion and is positioned between the heel portion and the body-fore end of the body. The fore boundary is positioned in front of the rear boundary between the rear boundary of the elevation portion and the body-fore end of the body. The thickness of the body decreases from the rear boundary to the fore boundary.

5 Claims, 7 Drawing Sheets

PRESSURE-REDUCING DEVICE

BACKGROUND OF THE INVENTION

1. Field of the Invention

The present invention relates to a pressure-reducing device, especially to a pressure-reducing device that release pressure applied to a heel of a foot.

2. Description of the Prior Art

Modern life styles characterized by metabolic syndromes, lack of exercise and chronic pains are widely recognized as a problem. The chronic pains may be due to unstable or unbalanced erect posture and usually persist for a long periods and cause damage to health. Unstable, unbalanced erect postures bring unnecessary tension to plantar muscles and thus cause long-term chronic pains. Maintaining a stable erect posture is an effective treatment for curing such chronic pain.

A stable erect posture is characterized by constituting a three-point-support structure constituted with three portions of a sole of a foot, wherein the portions respectively correspond to the first metatarsal bone, the fourth metatarsal bone and the heel of the foot. When pressure applied to the sole of the foot is distributed at a first metatarsal portion, a fourth metatarsal portion and a heel portion of the sole of the foot, an erect posture is stably maintained. It is apparent that an effective means to stably maintain erect posture is desired.

On the other hand, when wearing a heeled shoe, the heel of the foot will be raised and the aforementioned three-point-supporting structure will be disrupted. An effective means for maintaining erect posture is also desired.

To overcome the shortcomings, the present invention provides a pressure-reducing device to mitigate or obviate the aforementioned problems.

SUMMARY OF THE INVENTION

The main objective of the invention is to provide a pressure-reducing device maintaining a three-point-supporting structure to stably support the human body by releasing pressure applied to a heel of a foot in an erect posture.

The pressure-reducing device in accordance with the present invention has a body, a heel portion and an elevation portion. The body has a thickness and a body-fore end. The heel portion is defined in the body. The elevation portion is defined in the body and has a rear boundary and a fore boundary. The rear boundary is adjacent to the heel portion and is positioned between the heel portion and the body-fore end of the body. The fore boundary is positioned in front of the rear boundary between the rear boundary of the elevation portion and the body-fore end of the body. The thickness of the body decreases from the rear boundary to the fore boundary.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
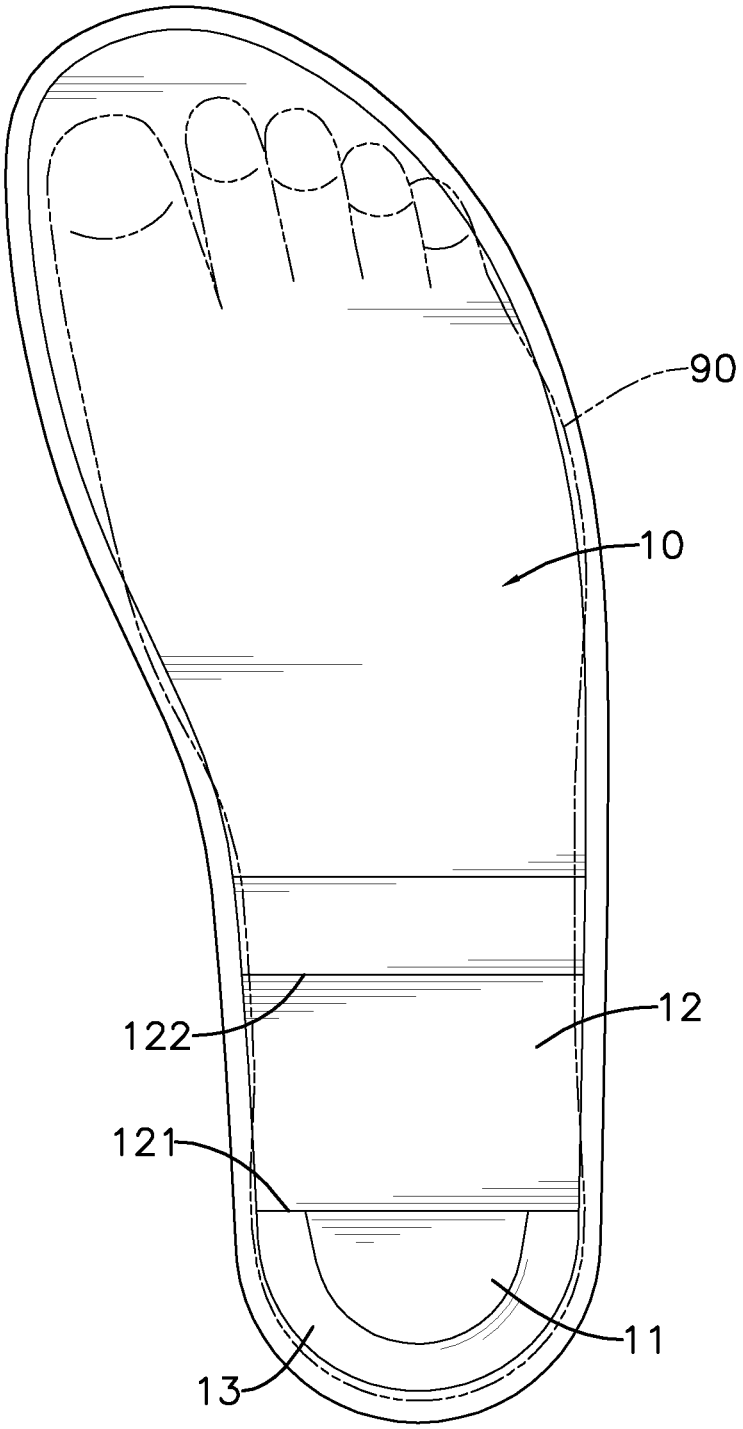
FIG. 1 is an operational top view of a first embodiment of a pressure-reducing device in accordance with the present invention.
Figure 2:
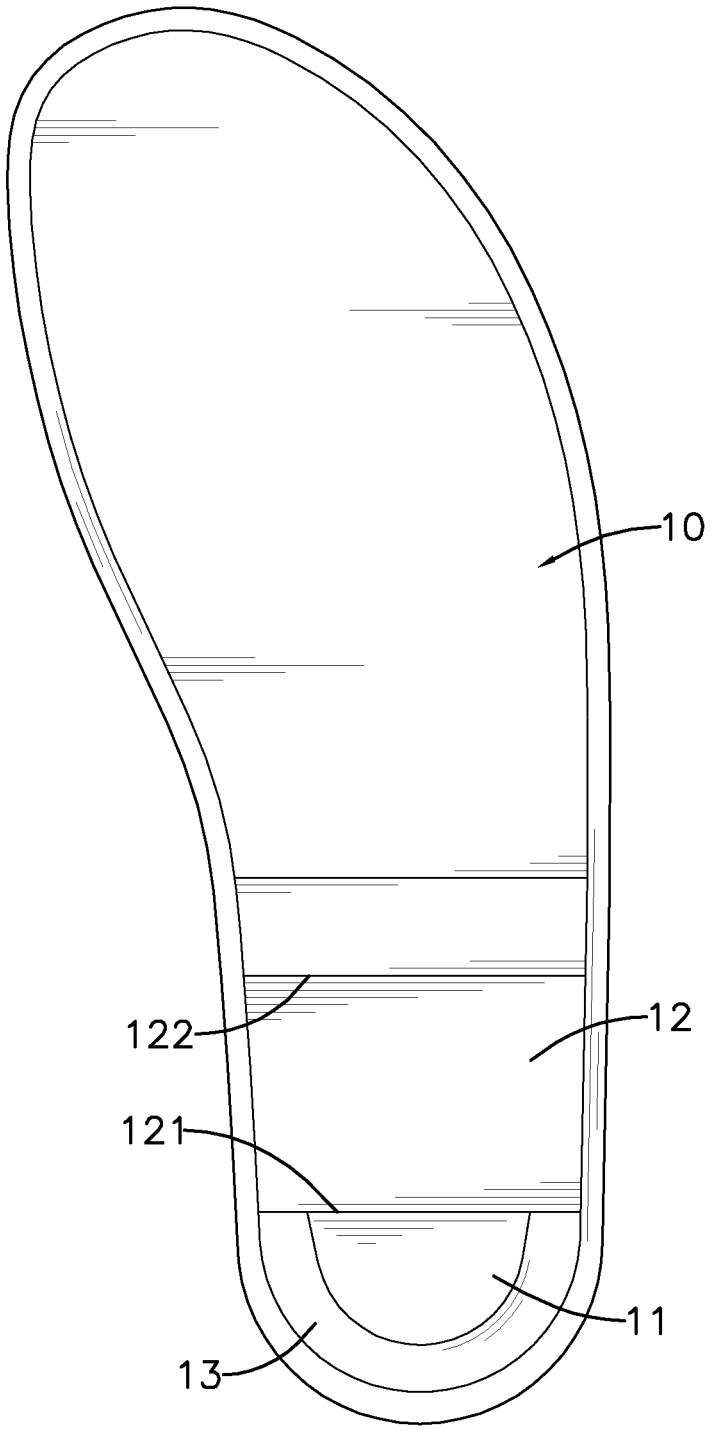
FIG. 2 is a top view of the pressure-reducing device in FIG. 1.

With reference to FIGS. 1 and 2, a first embodiment of a pressure-reducing device in accordance with the present invention comprises a body (10), a heel portion (11), an elevation portion (12) and an optional chamfer (13).

The body (10) is for padding a sole of a foot to provide a cushioning effect against a pressure applied to the sole of the foot during standing, walking or running. The body (10) is made with a cushioning material and has a top surface, a thickness and a body-fore end. The body (10) may be implemented as an insole, a midsole or an outsole of footwear such as a sandal or a slipper.

The heel portion (11) is defined in the body (10) for cushioning a heel of the foot and comprises a heal-right side, a heal-left side and a heal-rear end. The heel portion (11) may be formed on the top surface of the body (10).

The elevation portion (12) is defined in the body (10) and comprises an elevation-right side, an elevation-left side, a rear boundary (121) and a fore boundary (122). The elevation portion (12) may be formed on the top surface of the body (10). The rear boundary (121) is adjacent to the heel portion (11) and positioned between the heel portion (11) and the body-fore end of the body (10). The fore boundary (122) is positioned in front of the rear boundary (121) between the rear boundary (121) of the elevation portion (12) and the body-fore end of the body (10). The thickness of the body (10) decreases from the rear boundary (121) to the fore boundary (122) of the elevation portion (12). When the body (10) is implemented as an insole, a midsole or an outsole of footwear such as a sandal or a slipper, the elevation portion (12) is preferably formed on the top surface of the body (10). It is observed that a fall of level is formed between the rear boundary (121) to the fore boundary (122) of the elevation portion (12) in the first embodiment.

The chamfer (13) surrounds the heel-right side, the heel-left side and the heel-rear end of the heel portion (11) and comprises a chamfer-inner side. The body (10) is beveled such that the thickness of the body (10) decreases outwardly from the chamfer-inner side of the chamfer (13).

With the aforementioned structure, when the pressure-reducing device is used in a shoe for receiving a human foot (90), the sole of the foot (90) contacts the top surface of the body (10). Body weight is applied to the body (10), wherein the heel of the foot is positioned onto the heel portion (11) and the elevation portion (12). A rear half and a fore half of the heel are respectively supported by the heel portion (11) and the elevation portion (12). Since the thickness of the body (10) decreases from the rear boundary (121) to the fore boundary (122) and forms a structure such as a slope, the fore half of the heel does not contact the elevation portion (12) as solidly as the rear half contact the heel portion (11). As a result, pressure applied to the fore half of the heel is reduced.

It is considered best for an erectly walking human that the body weight is distributed at a first metatarsal portion around the first metatarsal bone, a fourth metatarsal portion around the fourth metatarsal bone and a heel portion around the heel. Distribution of body weight at these portions constitutes a three-point-supporting structure for stable support. Reducing pressure applied to the fore half of the heel further accentuates the aforementioned three-point-support structure. When standing, walking or running, uncomfortable pressure on the heel is reduced and at the same time a more stable three-point-supporting structure is better maintained.

Figure 3:
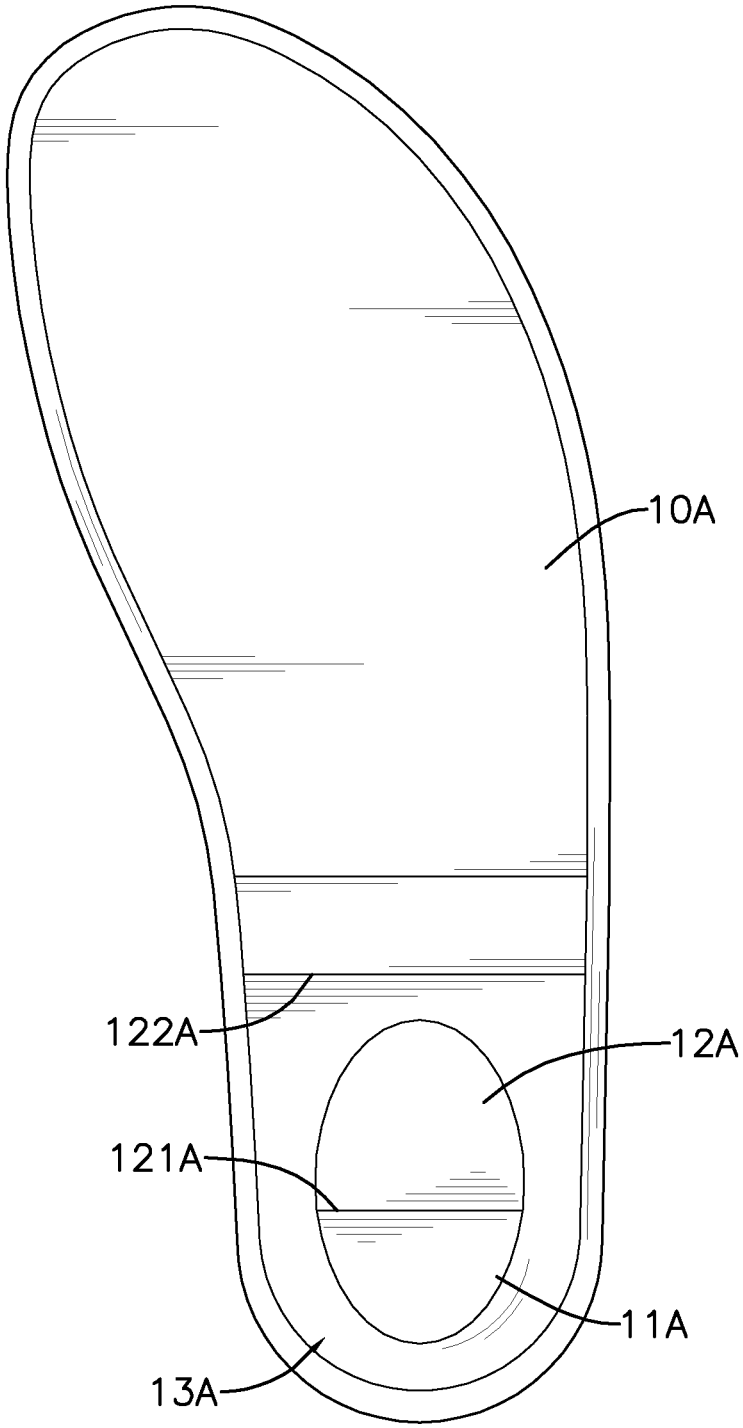
FIG. 3 is a top view of a second embodiment of a pressure-reducing device in accordance with the present invention.

With reference to FIG. 3, a second embodiment of a pressure-reducing device in accordance with the present invention also comprises a body (10A), a heel portion (11A), an elevation portion (12A) comprising a rear boundary (121A) and a fore boundary (122A) and a chamfer (13A).

The elevation portion (12A) of the second embodiment of the pressure-reducing device has a semielliptic shape and a semielliptic front line, wherein the front line is positioned between the rear boundary (121A) and the fore boundary (122A).

The chamfer (13A) further forwardly extends beside the elevation-right side and the elevation-left side and beyond the front line of the elevation portion (12A), so that the chamfer-inner side of the chamfer (13A) overlaps the elevation-right side, the elevation-left side and the front line of the elevation portion (12A). Hence the body (10A) is beveled such that the thickness of the body (10A) decreases outwards from the chamfer-inner side or the elevation-right side, the elevation-left side and the front line.

The thickness of the body (10A) decreases from the rear boundary (121A) to the front line and then further decreases from the front line to the fore boundary (122A). Thus the second embodiment of the pressure-reducing device releases pressure applied to the fore half of the heel with the aforementioned structure and maintains a balanced erect posture.

Figure 4:
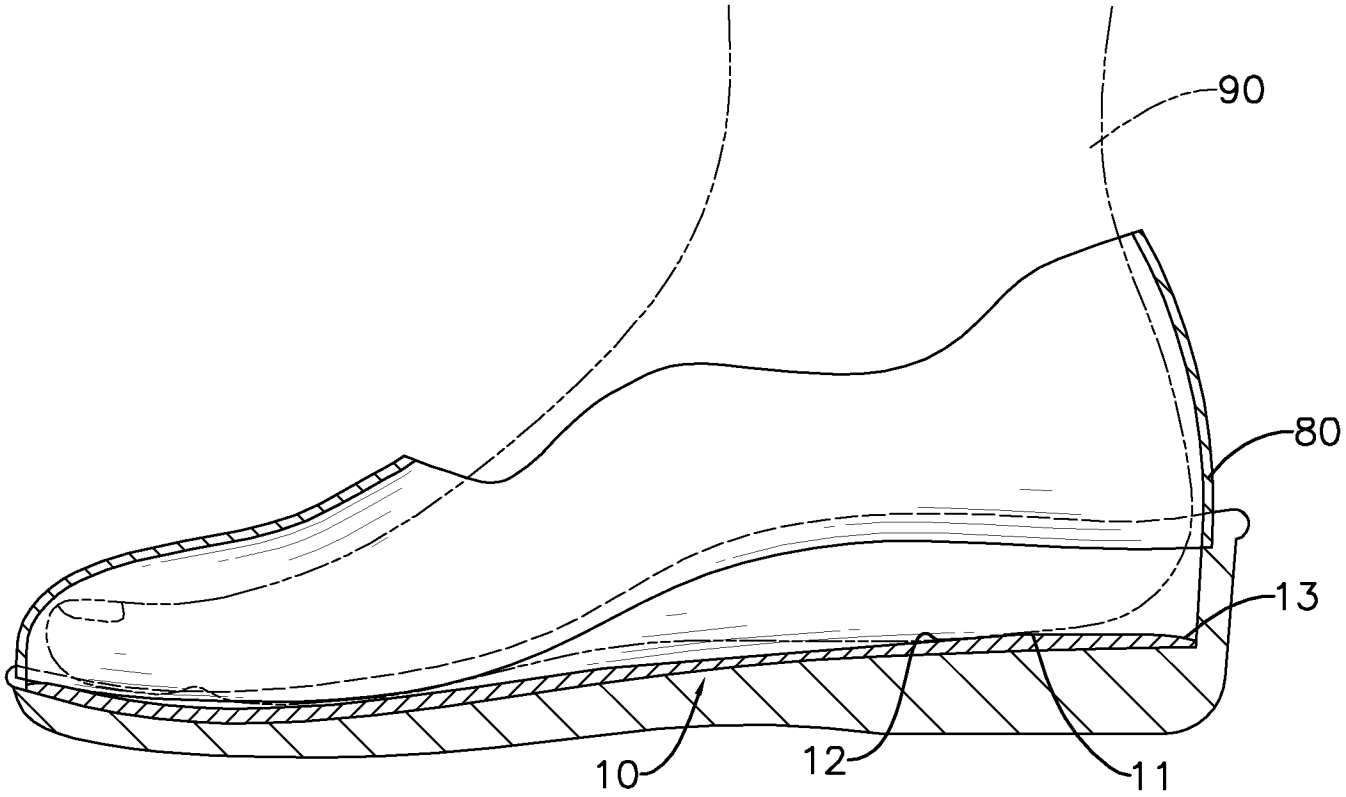
FIG. 4 is an operational side view in partial section of the pressure-reducing device in FIG. 1 implemented in a shoe.
Figure 5:
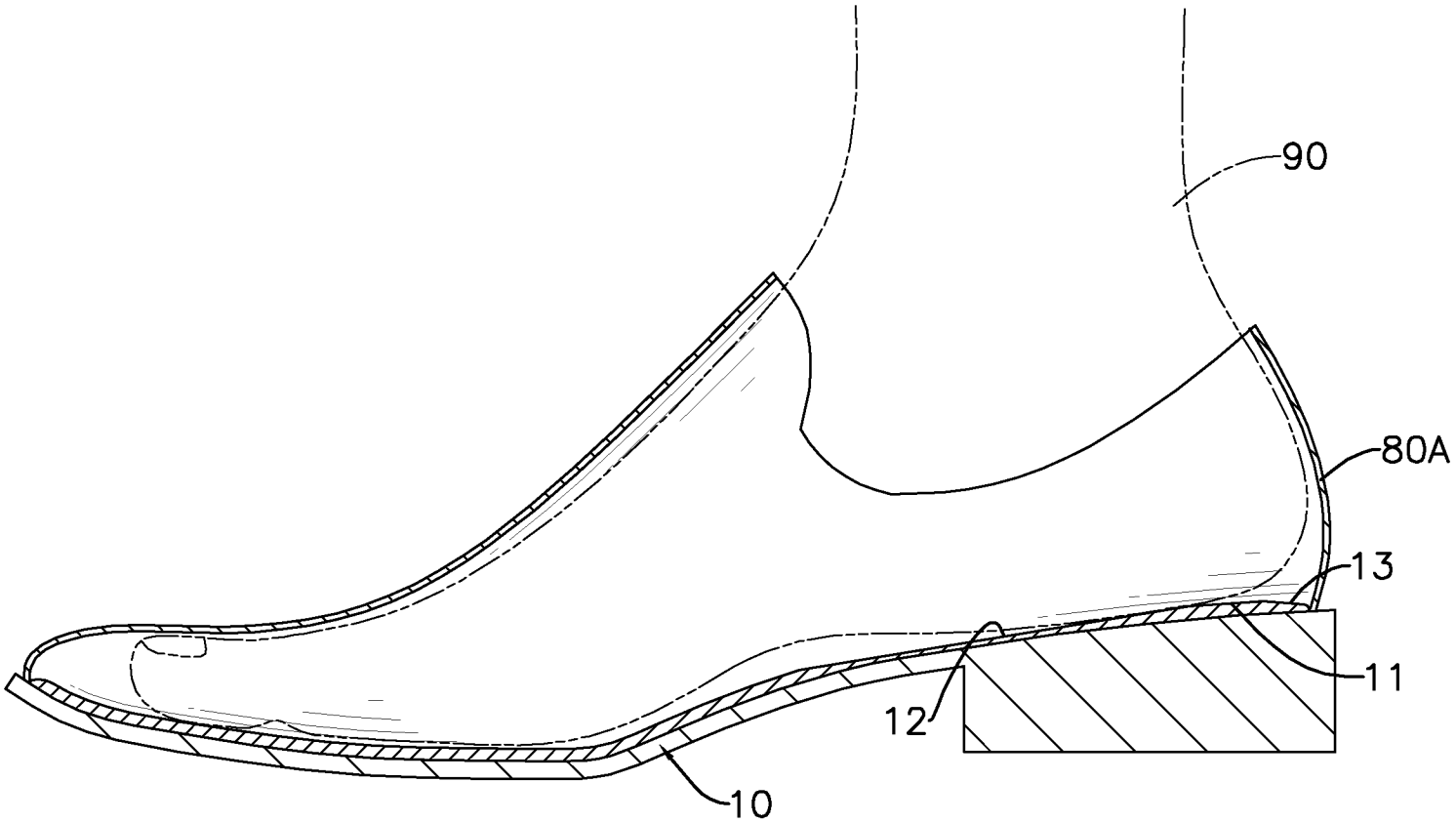
FIG. 5 is an operational side view in partial section of the pressure-reducing device in FIG. 1 implemented in a shoe with a shoe heel.

With reference to FIGS. 4 and 5, the pressure-reducing device in accordance with the present invention such as the aforementioned first and second embodiment thereof, may be implement in a flat shoe (80) or a heeled shoe (80A). The heel of the flat shoe (80) has a slope from its higher heel to its toe while the heeled shoe (80A) has a slope of higher gradient in the same orientation. The flat shoe (80) and the heeled shoe (80A) raises a user's heel, re-distributes pressure applied to the sole of the user's foot and disrupt the three-point-supporting structure to different extents. The user tends to lean forward and is not able to keep a stable erect posture without applying extra tension to his or her muscles. The extra muscle tension may cause chronic pain that damages health over a long periods of time.

Use of the pressure-reducing device balances the pressure distribution and restores the three-point-supporting structure for stable erect posture, so that the user may wear such flat shoe (80) or heeled shoe (80A) healthily without chronic pain resulting from unstable erect posture. With further reference to FIGS. 1 and 2, the optional chamfer (13) further reduces pressure applied to a periphery of the heel of the foot (90). With the elevation portion (12), the chamfer (13) balances an erect posture to a stable status and thus relives plantar muscles from unnecessary tension.

Figure 6:
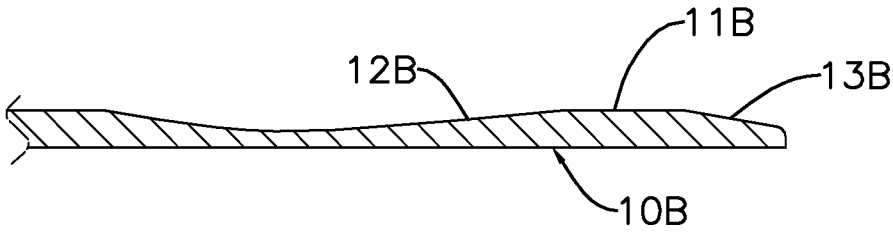
FIG. 6 is an enlarged cross sectional side view of a third embodiment of a pressure-reducing device in accordance with the present invention.

With reference to FIG. 6, a third embodiment of the pressure-reducing device in accordance with the present invention comprises a body (10B), a heel portion (11B), an elevation portion (12B) and a chamfer (13B). The thickness of the body (10B) decreases forwards within the elevation portion (12B). The chamfer (13B) of the third embodiment of the pressure-reducing device further has a round surface. The elevation portion (12B) reduces pressure applied to the fore half of the heel while the chamfer (13B) zzz the periphery thereof???. The elevation portion (12B) and the chamfer (13B) together balance the pressure distribution around the heel portion (11B) and help maintain stable erect posture without applying unnecessary tension to plantar muscles.

Figure 7:
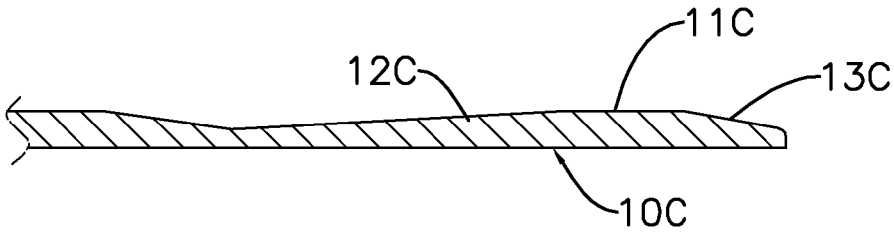
FIG. 7 is an enlarged cross sectional side view of a fourth embodiment of a pressure-reducing device in accordance with the present invention.
Figure 8:
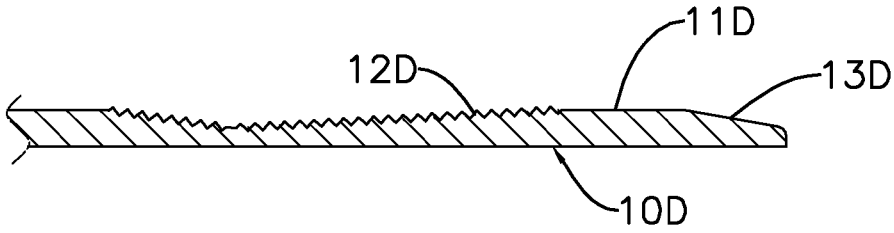
FIG. 8 is an enlarged cross sectional side view of a fifth embodiment of a pressure-reducing device in accordance with the present invention.
Figure 9:
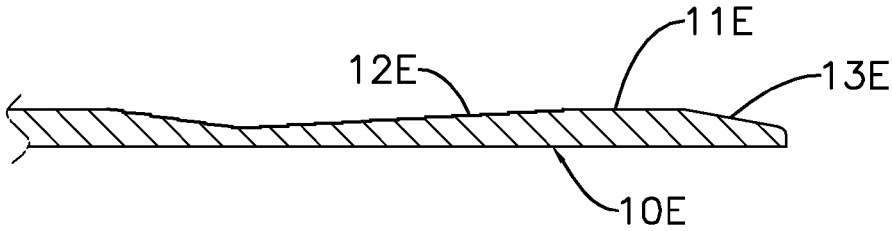
FIG. 9 is an enlarged cross sectional side view of a sixth embodiment of a pressure-reducing device in accordance with the present invention.

With reference to FIGS. 7 to 9, fourth, fifth and sixth embodiments of the pressure-reducing device, are implemented as the aforementioned embodiments, respectively comprise a body (10C, 10D, 10E), a heel portion (11C, 11D, 11E), an elevation portion (12C, 12D, 12E) and a chamfer (13C, 13D, 13E). The elevation portion (12C) of the fourth embodiment of the pressure-reducing device forms a slope having a different gradient. The elevation portion (12D) of the fifth embodiment of the pressure-reducing device has a zigzag appearance while the elevation portion (12E) of the sixth embodiment an irregular appearance. The fourth, fifth and sixth embodiments demonstrate that the appearance or gradient of the elevation portion (12C, 12D, 12E) does not limit the scope of the present invention. As long as the elevation portion (12C, 12D, 12E) maintains a structure that the thickness of the body (10C, 10D, 10E) decreases forwardly therewithin, the pressure-reducing device functions to reduce pressure applied to the fore half of the heel and help maintain a stable three-point-supporting structure for balanced erect posture.

Figure 10:
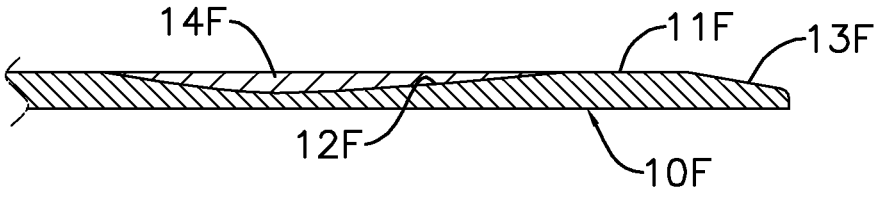
FIG. 10 is an enlarged cross sectional side view of a seventh embodiment of a pressure-reducing device in accordance with the present invention.

With reference to FIG. 10, a seventh embodiment of the pressure-reducing device comprises a body (10F), a heel portion (11F), an elevation portion (12F) and a chamfer (13F), wherein the body (10F) further has a soft member (14F). The soft member (14F) is made of a soft material softer than the aforementioned cushioning material. The soft member (14F) is attached to the elevation portion (12F), so to shape the body (10F) flat. The soft member (14F) yields more readily to pressure than the body (10F). Thus even combined with the soft member (14F), the elevation portion (12F) does not contact the fore half of the heel as solidly as the heel portion (11F) contacts the rear half of the heel. The seventh embodiment of the pressure-reducing device provides a body (10F) of flat shape that may be more familiar to users used to conventional shoe inserts while maintaining the function of balancing an erect posture and preventing chronic pain.

Figure 11:
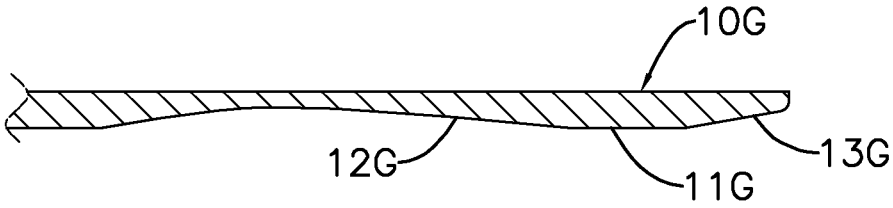
FIG. 11 is an enlarged cross sectional side view of an eighth embodiment of a pressure-reducing device in accordance with the present invention.

With reference to FIG. 11, an eighth embodiment of the pressure-reducing device comprises a body (10G), a heel portion (11G), an elevation portion (12G) and a chamfer (13G). The body (10G) has a bottom surface and a flat top surface. The heel portion (11G) and the elevation portion (12G) are formed on the bottom surface of the body (10G).

Although the heel portion (11G) and the elevation portion (12G) are formed on the bottom surface of the body (10G), the thickness of the body (10G) does forwardly decrease within the elevation portion (12G). In other words, the thickness of the body (10G) within the heel portion (11G) is thicker than that of the elevation portion (12G). When using the eighth embodiment, the sole of the foot contacts the flat top surface of the body (10G). However, because of the elevation portion (12G) and the heel portion (11G) formed on the bottom surface, the fore half of the heel does not contact the top surface of the body (10G) as solidly as the rear half does. Thus the eighth embodiment functions as other embodiments and is able to stably support a balanced erect posture to eliminate chronic pain. A soft member as described with the seventh embodiment may be attached to the elevation portion (12G) of the eighth embodiment to shape the body (10G) flat.

With the description of the aforementioned embodiments, one skilled artisan will be able to understand that the present provides a pressure-reducing device that maintain the aforementioned three-point-supporting structure for stable supporting and balancing an erect posture. By maintain the welled balanced erected posture, the plantar muscles of the user is free from unnecessary tension and thus prevent chronic pain that might direct to long-term damaging to health.

What is claimed is:

1. A pressure-reducing device comprising a body comprising a thickness; and a body-fore end;

a heel portion defined in the body for cushioning a heel of a foot and comprising a heel-right side;

a heel-left side; and a heel-rear end; and an elevation portion defined in the body and comprising an elevation-right side;

an elevation-left side;

a rear boundary adjacent to the heel portion and positioned between the heel portion and the body-fore end of the body; and a fore boundary positioned in front of the rear boundary between the rear boundary of the elevation portion and the body-fore end of the body, wherein the thickness of the body decreases from the rear boundary to the fore boundary;

wherein the body further comprises:

a chamfer surrounding the heel-right side, the heel-left side and the heel-rear end of the heel portion and comprising a chamfer-inner side, wherein the body is beveled that the thickness of the body outwardly decreases from the chamfer-inner side;

wherein the elevation portion further comprises a front line positioned between the rear boundary and the fore boundary; and the chamfer further forwardly extends aside the elevation-right side and the elevation-left side and beyond the front line of the elevation portion, wherein the chamfer-inner side laps over the elevation-right side, the elevation-left side and the front line of the elevation portion; and wherein the body is selected from the group consisting of an insole made with a cushioning material, an midsole made with a cushioning material, and a outsole made with a cushioning material.

2. The pressure-reducing device as claimed in claim 1, wherein the body has a top surface; and the heel portion and the elevation portion are formed on the top surface of the body.

3. The pressure-reducing device as claimed in claim 1, wherein the body has a bottom surface; and the heel portion and the elevation portion are formed on the bottom surface of the body.

4. The pressure-reducing device as claimed in claim 2, wherein the body further has a soft member made of a soft material attached to and compensating the elevation portion to shape the body flat.

5. The pressure-reducing device as claimed in claim 3, wherein the body further has a soft member made of a soft material attached to and compensating the elevation portion to shape the body flat.

* * * * *